United States Patent [19]

Miyaoka

[11] Patent Number: 5,067,321

[45] Date of Patent: Nov. 26, 1991

[54] HYDRAULIC HOISTING CIRCUIT WITH ELECTRICAL CONTROL FOR RELIEF VALVE ADJUSTMENT PILOT AND PILOT DISABLE VALVE

[75] Inventor: Satoshi Miyaoka, Hiroshima, Japan

[73] Assignee: Kabushiki Kaisha Kobe Seiko Sho, Kobe, Japan

[21] Appl. No.: 480,145

[22] Filed: Feb. 14, 1990

[30] Foreign Application Priority Data

Feb. 23, 1989 [JP] Japan ..... 1-44839

[51] Int. Cl.[5] ..... E02F 3/32; E02F 9/20; E02F 9/22; F15B 11/02

[52] U.S. Cl. ..... 60/426; 60/427; 60/468; 91/529

[58] Field of Search ..... 60/465, 468, 494, 427, 60/426; 91/529, 451; 37/103

[56] References Cited

U.S. PATENT DOCUMENTS

| | | | |
|---|---|---|---|
| 4,087,968 | 5/1978 | Bianchetta | 60/445 |
| 4,218,837 | 8/1980 | Peterman | 37/103 |
| 4,317,466 | 3/1982 | Ikeda et al. | 91/451 X |
| 4,365,429 | 12/1982 | Ecker et al. | 37/103 |

FOREIGN PATENT DOCUMENTS

| | | | |
|---|---|---|---|
| 3134869 | 3/1983 | Fed. Rep. of Germany | 91/451 |
| 57-201434 | 12/1982 | Japan . | |
| 17003 | 1/1984 | Japan | 91/451 |
| 61-165432 | 7/1986 | Japan . | |

*Primary Examiner*—Edward K. Look
*Assistant Examiner*—George Kapsalas
*Attorney, Agent, or Firm*—Oblon, Spivak, McClelland, Maier & Neustadt

[57] ABSTRACT

A hydraulic circuit for a piece of construction equipment such as a hydraulic shovel. The operation of the hydraulic shovel is controlled by a number of hydraulic actuators which are provided with a high pressure oil through selector valves. A main relief valve prevents an excessive pressure from developing in the vicinity of a main pump, and port relief valves associated with the individual actuators prevent excessive pressures from reaching each actuator. Pilot lines carry a biasing oil pressure from a pilot pump to the main relief valve and to at least one of the port relief valves to boost the relief pressures in the circuit in response to a signal from an operator controlled switch. Simultaneously with effecting a boosting of relief pressure in the relief valves, the operator controlled switch renders one of the actuators inoperative using a shut-off valve so that it may not be operated while the relief pressures are boosted.

3 Claims, 6 Drawing Sheets

HYDRAULIC HOISTING CIRCUIT WITH ELECTRICAL CONTROL FOR RELIEF VALVE ADJUSTMENT PILOT AND PILOT DISABLE VALVE

BACKGROUND OF THE INVENTION

The present invention relates to a hydraulic circuit for a hydraulic construction and working machine.

Conventionally, a construction and working machine is utilized not only for its primary purpose, but for multiple purposes owing to its good mobility and stability of a machine body.

Particularly in a hydraulic construction machine having a working device overhung from the machine body, the usage thereof tends to become diversified. FIG. 6 shows an example of a hydraulic shovel. The hydraulic shovel is primarily used for excavation of earth and sand at a level lower than a ground surface. A substance to be excavated contains hard and soft rock, earth and sand in a mixed condition, and the specific gravity of the substance is indefinite. Accordingly, an excavating resistance is fluctuated according to the substance, and an impact load is often applied to the machine. To prevent such a fluctuated load from adversely affecting the strengths of a machine body, boom 38, arm 39, bucket 40 and members related thereto, and also ensure a sufficient stability of the machine body during operation, the hydraulic shovel is provided with a limiting device for limiting an output and a holding power of hydraulic cylinders 14, 15 and 16 within a predetermined value.

In another kind of work such that the fluctuated load or the impact load is not applied in using the working device of the hydraulic shovel, e.g., in hoisting a heavy load on the ground or pulling a pile in the earth by rotating the boom 38 and the arm 39 to be operated by the hydraulic cylinders 14 and 16, respectively, there is no problem in the stability of the machine body and the strengths of the boom 38 and the arm 39 even if the operating forces of the hydraulic cylinders 14 and 16 are greater than those in the normal construction work. Such increased operating forces are rather advantageous for enlargement of a hoisting power or a pulling power, thus contributing to an improvement in capacity of the machine for this kind of work.

FIG. 3 is a diagram of an essential part of a hydraulic system in a general-purpose hydraulic prior art shovel of a construction and working machine. The operation of the hydraulic cylinder 14 for the boom 38 as shown in FIG. 6 will now be described. Referring to FIG. 3, a discharge pressure oil from a main pump 3 is allowed to flow into a hydraulic selector valve group A, and a main relief valve 23 is provided in a line leading from the main pump 3 to the hydraulic selector valve group A so as to limit the discharge oil pressure within a predetermined value, thereby protecting equipment in the hydraulic circuit and preventing excess outputs from various actuators. When a hydraulic selector valve 8 for the boom 38 is operated, the pressure oil admitted into the hydraulic selector valve group A serves to contract the hydraulic cylinder 14, wherein a contracting force of the hydraulic cylinder 14 is limited so as not to exceed a predetermined value in accordance with the set pressure of the main relief valve 23. Further, port relief valves 17 and 18 are provided in branch lines extending from lines leading from the hydraulic selector valve 8 to head-side and rod-side oil chambers of the hydraulic cylinder 14, so as to prevent breakage or deformation of boom 38 resulting from an abnormal stress generated by an external force greater than the above predetermined value. A set pressure of the port relief valves 17 and 18 is normally set to be slightly higher than that of the main relief valve 23, so that there may be no problem in a normal excavating operation by the boom 38, and only when an abnormal external force is applied to the boom 38, may the hydraulic cylinder 14 be freely expanded and contracted.

Although the above description is directed to the hydraulic cylinder 14 only with reference to FIG. 3, the same measures are provided for the other hydraulic cylinders 15 and 16.

However, in the hoisting or pulling work with the set pressure of each relief valve suitable for the excavating work, there occurs a problem that a working efficiency cannot be improved. To cope with this problem, the prior art has often taken the following measures. That is, as shown in FIG. 4, the main relief valve 23 is provided with a boosting pilot oil chamber 27 for boosting the set pressure of the main relief valve 23 by means of a pilot pressure. Furthermore, the set pressure of a port relief valve 17*a* leading to the load-side oil chamber of the hydraulic cylinder 14 is set to be higher than that in the normal excavating work in a range such that a static load stress generating in each part of the machine is permitted. In hoisting a heavy load or pulling a pile where no impact load is applied, a switch 30 located near a driving seat is operated as required to actuate hydraulic signal generating means 31 which in turn supplies a discharge pressure oil from a pilot pump 4 as a signal to the boosting pilot oil chamber 27.

Although the above description is directed to the hydraulic cylinder 14 for the boom 38, the same measures are taken for the other hydraulic cylinders 15 and 16 for the bucket 40 and the arm 39, respectively. According to the hydraulic circuit as shown in FIG. 4, the operating force of the hydraulic cylinders can be increased by an increased amount of the set pressure of the main relief valve 23 in the hoisting or pulling work generating no impact load, and a resisting force against an external force can of course be increased by an increased amount of the set pressure of the port relief valve 17*a*.

FIG. 5 is a diagram of an essential part of a hydraulic system as improved from the prior art shown in FIG. 4. Referring to FIG. 5, the port relief valve 17 leading to the load-side oil chamber of the hydraulic cylinder 14 is provided with a boosting pilot oil chamber 25 similar to the boosting pilot oil chamber 27 for the main relief valve 23. Both the boosting pilot oil chambers 25 and 27 are connected through pilot lines to the hydraulic signal generating means 31.

In such an improved hydraulic system, when the switch 30 is in an open state, the relief set pressures of the main relief valve 23 and the port relief valve 17 are maintained at the normal set pressures suitable for an excavating work of the hydraulic shovel, thus avoiding application of an excess load due to an external force. In the hoisting or pulling work generating no impact load as mentioned above with reference to FIG. 4, when the switch 30 is closed, the set pressures of the main relief valve 23 and the port relief valve 17 are increased to thereby increase the operating force of the hydraulic cylinder and the holding force in the oil chamber of the hydraulic cylinder 14 leading to the port relief valve 17.

In the construction machine employing the above-mentioned hydraulic circuit, there is a chance that an excavating force should be instantaneously increased during excavation as well as the hoisting or pulling work. In this case, the hydraulic signal generating means 31 may be operated by depressing an auto-return switch such as a push-button switch, wherein the operator must make sure of absolutely no application of an impact load; otherwise the strengths of the boom 38, the arm 39 and the bucket 40 must be increased so as to endure the increased excavating force, and the machine body must be so constructed as to endure a gravity of the strengthened working device.

As described above, the prior art hydraulic circuit for the construction and working machine is designed to increase the set pressure of the main relief valve by operating the switch or the push-button switch with the set pressure of the port relief valve previously boosted in hoisting a heavy load or pulling a pile or the like. However, when the engine is unintentionally stopped by any factors, or the operator erroneously opens the switch or releases his hand from the push-button switch during a hoisted condition of the heavy load, there is a danger that the heavy load will fall. Moreover, as the excavating work can be carried out with the set pressure of the main relief valve remaining increased, an excess force will be applied to the attachments at all times. Even if the set pressure of the main relief valve is not increased, the attachments inclusive of the boom, the arm and the bucket as well as the machine body will be adversely affected by an external force since the set pressure of the port relief valve is set to be higher than that in the normal excavating work.

SUMMARY OF THE INVENTION

It is accordingly an object of the present invention to provide a safety hydraulic circuit which may automatically suppress an excavating operation when the relief set pressures of the main relief valve and the port relief valve are boosted, and further may prevent that a heavy load being hoisted will fall even when the engine is stopped or the operator erroneously releases his hand from the push-button switch.

According to the present invention, the above object has been achieved by the following measures. That is, the hydraulic circuit according to the present invention comprises:

(1) hydraulic signal generating means for generating a hydraulic signal from a hydraulic source utilizing a discharge pressure oil from a pilot pump for an operating system or a pressure oil from a load-side oil chamber for an actuator for supporting a working device when a receiving section of said hydraulic signal generating means receives an external signal;

(2) a main relief valve and a port relief valve both having boost receiving means for boosting a relief pressure of these relief valves to a value higher than a normal set pressure when the hydraulic signal from the hydraulic signal generating means is applied to the boost receiving means;

(3) operation suppressing means for holding a neutral position of a hydraulic selector valve for operating a specific one of the actuators irrespective of an operation command to the hydraulic selector valve when a receiving section of the operation suppressing means receives an external signal; and (4) signal generating means for arbitrarily generating a signal and stopping the generation of the signal by an operator;

(5) wherein the signal from the signal generating means is supplied directly to the receiving sections of said hydraulic signal generating means and said operation suppressing means, or supplied thereto through a relay circuit comprised of a pressure switch for detecting the oil pressure in the load-side oil chamber of the actuator for supporting the working device, said pressure switch being operated when the oil pressure detected is higher than a predetermined value, and of a make contact, wherein the relay circuit functions to hold outputting of the signal received from the signal generating means as far as the operation switch is in a closed state.

In a normal construction operation, e.g., an excavating operation, the signal generating means is in and off position to stop the generation of a signal therefrom, and the working is started. Under this condition, the set pressure of the main relief valve and the port relief valve is maintained at a normal value suitable for the excavating work. Therefore, there is no possibility that an impact load or an excess load will be applied to the attachment to cause breakage thereof during the excavating work.

In a special work exhibiting a maximum capacity such as hoisting of a heavy load or pulling of a pile, the signal generating means is operated to apply a signal directly to or through the relay circuit to the receiving sections of the hydraulic signal generating means and the operation suppressing means. As a result, the hydraulic signal from the hydraulic signal generating means is applied to the boost receiving means of the main relief valve and the port relief valve to thereby boost the relief set pressure to a value higher than the normal value mentioned above. Accordingly, a working power and a holding power of the attachment can be increased. At the same time, since the receiving section of the operation suppressing means receives the signal from the signal generating means, the operation suppressing means functions to hold a neutral position of a hydraulic selector valve for operating a specific actuator, e.g., a bucket in a hydraulic backhoe, irrespective of an operation command to the actuator, which actuator is necessary for the excavating work or the like but unnecessary for the hoisting or pulling work. Therefore, the specific actuator, e.g., the bucket is inhibited from being actuated. That is, the excavating operation cannot be naturally effected under an increased relief set pressure of the main relief valve and the port relief valve, thus protecting the attachment or the like.

In the case that the pressure oil in the load-side oil chamber of an actuator for supporting the working device and receiving a load thereof, e.g., a hydraulic boom cylinder in a hydraulic backhoe is supplied as a hydraulic source to the hydraulic signal generating means, and the signal from the signal generating means is supplied through the relay circuit to the receiving sections of the operation suppressing means and the hydraulic signal generating means, an output signal from the relay circuit continues to be generated as far as the pressure switch in the relay circuit is maintained operative by the pressure oil from the load-side oil chamber of the hydraulic boom cylinder, thereby maintaining the boosted condition of the main relief valve and the port relief valve. Accordingly, even when the engine is unintentionally stopped during operation or the operator erroneously stops the signal from the signal generating means, there is no danger that the working device and the heavy load supported thereby will fall. At the same time, the output signal from the relay circuit also continues to be supplied to the selector valve as the operation suppressing means.

Other objects and features of the invention will be more fully understood from the following detailed description and appended claims when taken with the accompanying drawings.

DETAILED DESCRIPTION OF THE PREFERRED EMBODIMENTS

There will now be described some preferred embodiments of the present invention with reference to the drawings.

Figure 1:
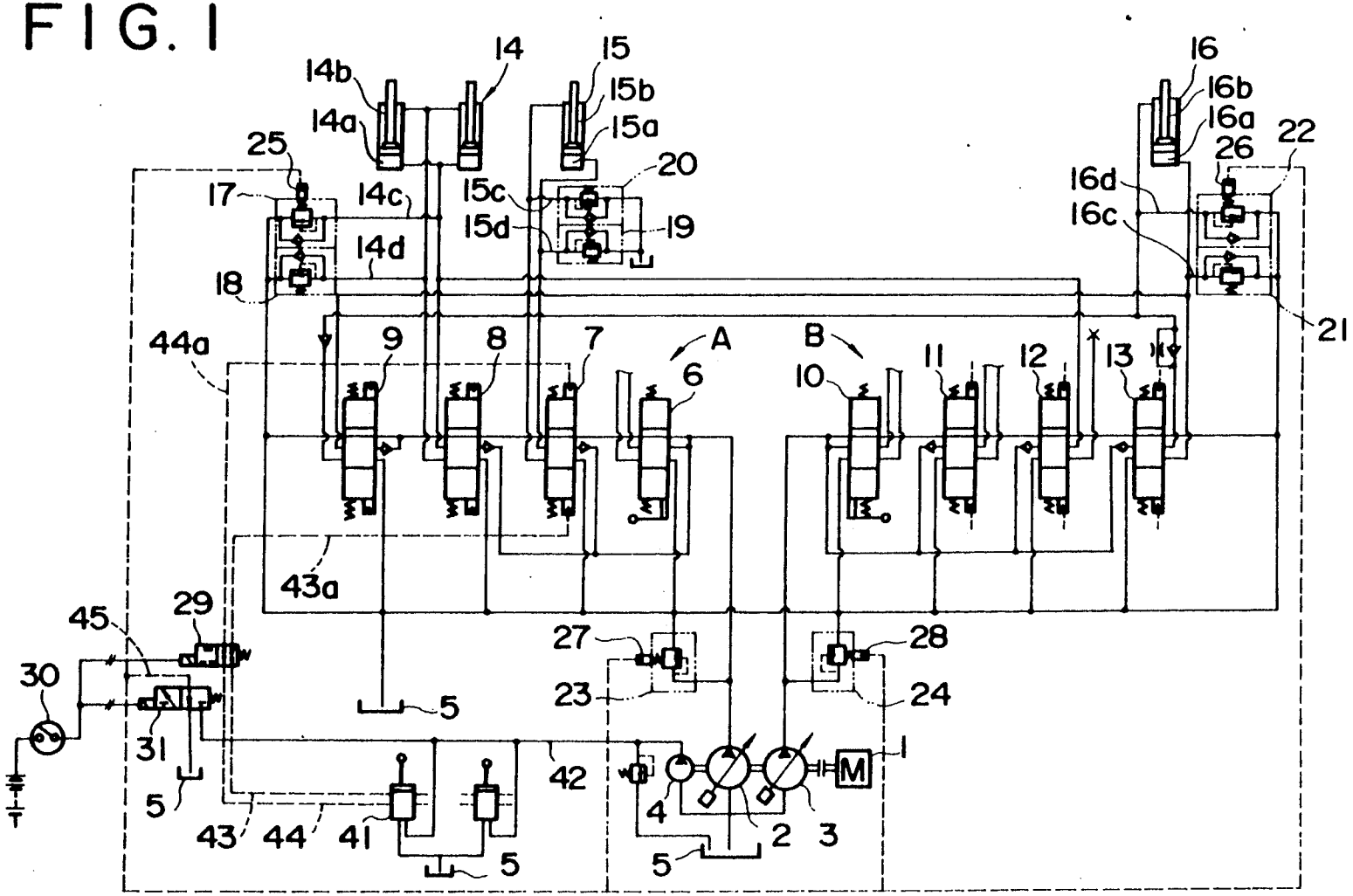
FIG. 1 is a diagram of an electric and hydraulic system according to a first preferred embodiment of the present invention.

FIG. 1 is a diagrammatic view of an electric and hydraulic system of an essential part of a hydraulic circuit according to a first preferred embodiment of the present invention as applied to a hydraulic shovel.

Referring to FIG. 1, reference numeral 1 designates an engine for driving main pumps 2 and 3 and a pilot pump 4. A discharge pressure oil from the main pump 2 is adapted to flow into a hydraulic selector valve group A consisting of hydraulic selector valves 6, 7, 8 and 9, while a discharge pressure oil from the main pump 3 is adapted to flow into a hydraulic selector valve group B consisting of hydraulic selector valves 10, 11, 12 and 13. Further, a discharge pressure oil from the pilot pump 4 is employed primarily as a hydraulic pressure source for an operating system, and it is fed to a line 42.

Reference numeral 14 designates a hydraulic boom cylinder adapted to be operated by select operation of the hydraulic selector valves 8 and 12; 15 designates a hydraulic bucket cylinder adapted to be operated by select operation of the hydraulic selector valve 7; and 16 designates a hydraulic arm cylinder adapted to be operated by select operation of the hydraulic selector valves 13 and 9. Reference numerals 17, 18, 19, 20, 21 and 22 designate port relief valves provided in branch lines 14*c*, 14*d*, 15*c*, 15*d*, 16*c* and 16*d* extending from lines leading to head-side and rod-side oil chambers 14*a*, 14*b*, 15*a*, 15*b*, 16*a* and 16*b* of the above-mentioned hydraulic cylinders, respectively; and 23 and 24 designate main relief valves for preventing that the discharge oil pressure from the main pumps 2 and 3 will become higher than a set pressure. Generally, a relief set pressure of the port relief valves is set to be slightly higher than that of the main relief valves. Reference numerals 25, 26 and 27, 28 designate boosting pilot oil chambers provided at relief pressure setting sections of the port relief valves 17 and 22 and the main relief valves 23 and 24, respectively. The boosting oil chambers 25 to 28 function as boost receiving means for boosting the relief set pressure of the port relief valves 17 and 22 and the main relief valves 23 and 24 up to a predetermined value when a signal pressure is applied to the boosting pilot oil chambers. Reference numeral 29 designates a selector valve for normally opening pilot lines 43 and 43*a* or pilot lines 44 and 44*a* extending from a remote control valve 41 so that a pilot pressure as an operating signal from the remote control valve 41 may be transmitted via the pilot lines 43, 43*a* or 44, 44*a* to the hydraulic selector valve 7 to thereby operate the same, while being selected when a signal is received by a receiving section of the selector valve 29, closing the pilot lines 43 and 44 from the remote control valve 41 and communicating the pilot lines 43*a* and 44*a* with each other to lead the same to the hydraulic selector valve 7. Thus, the selector valve 29 functions as operation suppressing means for automatically maintaining a neutral position of the hydraulic selector valve 7 when a signal is applied to the selector valve 29, in spite of the condition where the remote control valve 41 is operated to generate a pilot pressure in the pilot lines 43 and 44.

Reference numeral 31 designates hydraulic signal generating means for boosting the relief set pressure of the port relief valves 17 and 22 and the main relief valves 23 and 24. That is, when a receiving section of the hydraulic signal generating means 31 receives a signal, a pressure oil from the line 42 is employed as a hydraulic pressure source, and the pressure oil as a pilot pressure is transmitted through a pilot line 45 to the boosting pilot oil chambers 25, 26, 27 and 28, thereby boosting the relief set pressure. Reference numeral 30 designates a switch provided near a driving seat and adapted to be arbitrarily operated by an operator. The switch 30 functions to switch the transmission and cutting of the signals to the respective receiving sections of the selector valve 29 as the operation suppressing means and the hydraulic signal generating means 31. The switch 30 may be constructed of a push-button switch adapted to become on only when it is depressed.

The operation of the above-mentioned preferred embodiment will now be described.

In case of using the hydraulic shovel as an original construction machine, the switch 30 is maintained open. Accordingly, both the selector valve 29 and the hydraulic signal generating means 31 are not operated, and the pilot lines 43 and 44 from the remote control valve 41 are communicated through the selector valve 29 to the pilot lines 43*a* and 44*a*, respectively, thereby making the hydraulic selector valve 7 in an operative condition. Further, as the pilot line 45 is communicated through the hydraulic signal generating means 31 to a tank 5, no hydraulic signals are applied to the boosting pilot oil chambers 25, 26, 27 and 28. Accordingly, the port relief valves 17 and 22 and the main relief valves 23 and 24 maintain respective normal set pressures suitable for an excavating operation, thus preventing an excess force from being applied to working devices such as a boom 38, arm 39 and bucket 40 as well as a machine body and thereby ensuring the stability and safety in the excavating operation.

Figure 6:
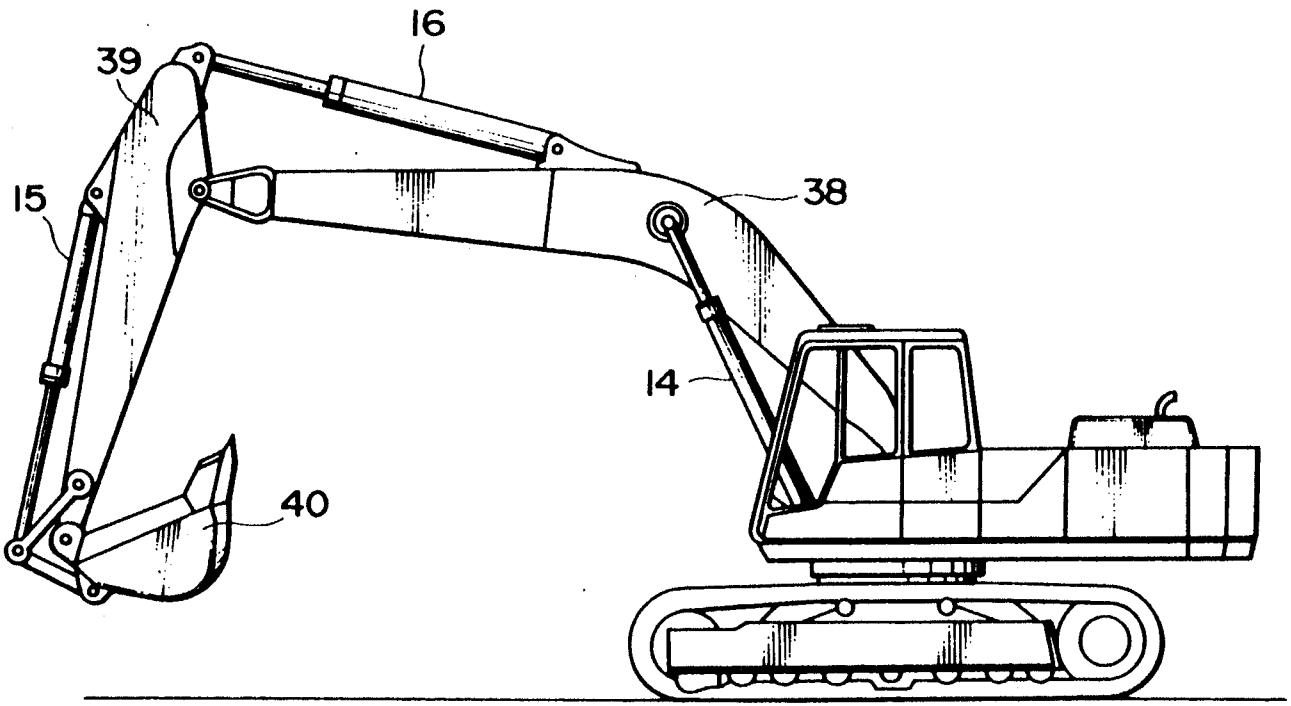
FIG. 6 PRIOR ART
FIG. 6 is a side view of the hydraulic shovel, also in the prior art.

In a specific kind of work meeting a given condition, the hydraulic shovel can lift, hang and move a heavy load such as equipment and materials as similar to a crane. In such a kind of operation different from the excavating operation, a working speed is low, and a known weight is handled. Furthermore, no impact load is generated. Therefore, even when a lifting capacity of the boom 38 and the arm 39 as shown in FIG. 6 is increased, the safety in working from the viewpoints of strength and stability is ensured, and a working efficiency is improved. However, there is a possibility that the excavating work is carried out with the lifting capacity remaining increased, thus causing damage to the machine.

In the electric and hydraulic system shown in FIG. 1, when the switch 30 is closed, a signal is applied to the hydraulic signal generating means 31, and the pressure oil from the line 42 is brought into communication through the hydraulic signal generating means 31 to the pilot line 45. Then, the pressure oil is applied to the boosting pilot oil chambers 25, 26, 27 and 28. Therefore, the relief set pressures of the port relief valves 17 and 22 and the main relief valves 23 and 24 are set to be higher than those in the normal excavating operation. Accordingly, a discharge pressure from the main pumps 2 and 3 to be applied to the head-side oil chamber 14*a* of the hydraulic boom cylinder 14 and the rod-side oil chamber 16*b* of the hydraulic arm cylinder 16 and a retaining pressure of the above oil chambers can be increased, thereby increasing a lifting capacity of the arm 39 at its forward end and a heavy load retaining capacity and improving a working efficiency. At the same time, the signal from the switch 30 is also applied to the selector valve 29 as the operation suppressing means, and the hydraulic selector valve 7 is brought into an inoperative condition. That is, even when the remote control valve 41 is operated to generate a pilot pressure in the pilot line 43 or 44, the pilot lines 43*a* and 44*a* are brought into communication with each other through an internal passage in the selector valve 29 having been selected in its position, thereby maintaining a neutral position of the hydraulic selector valve 7. Therefore, the hydraulic bucket cylinder 15 is not operated irrespective of the operation of the remote control valve 41. Consequently, while the relief set pressures of the relief valves 17, 22, 23 and 24 are being increased, the excavating work generating an impact load can be automatically suppressed.

Figure 2:
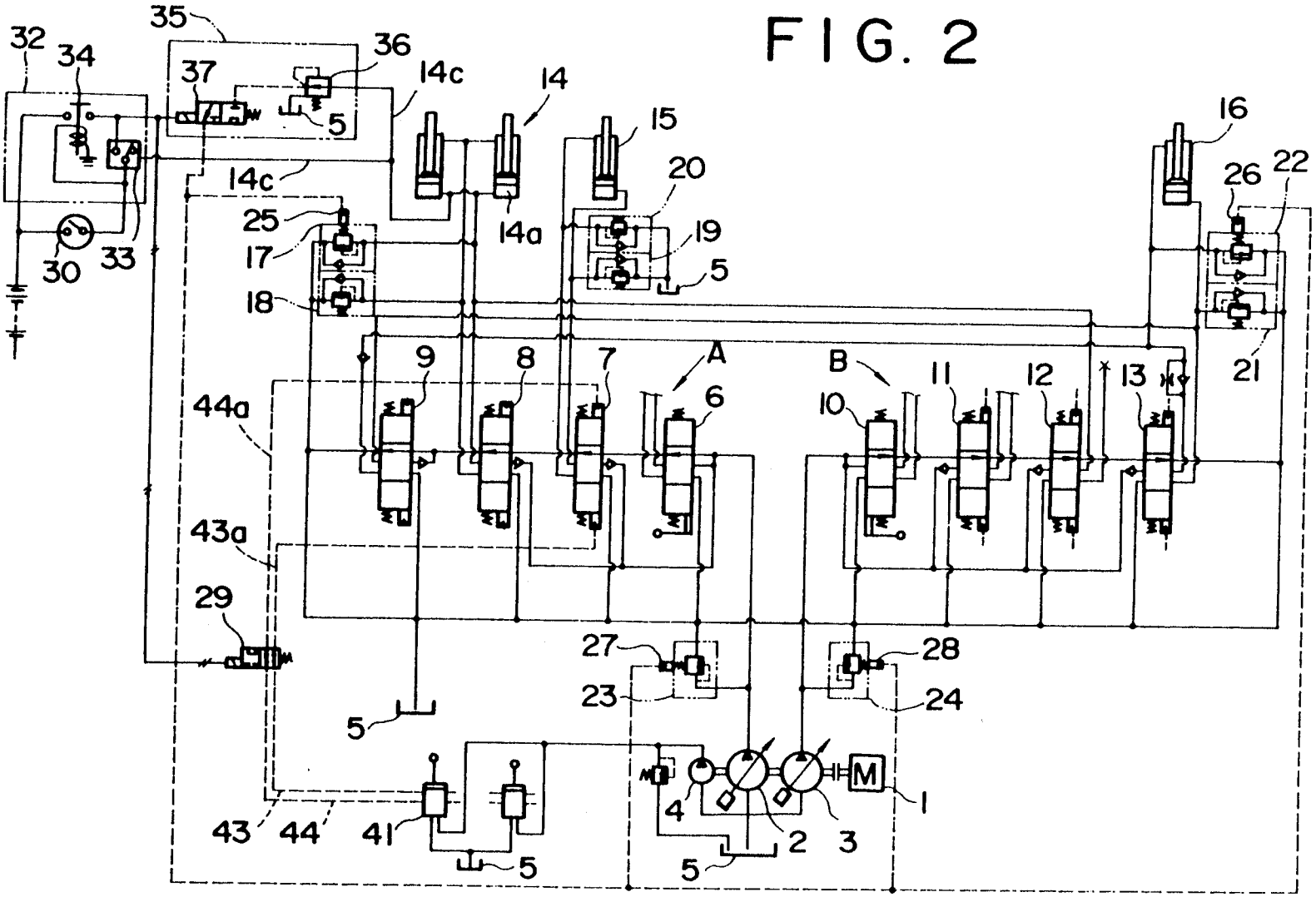
FIG. 2 is a diagram of an electric and hydraulic system according to a second preferred embodiment of the present invention.
Figure 3:
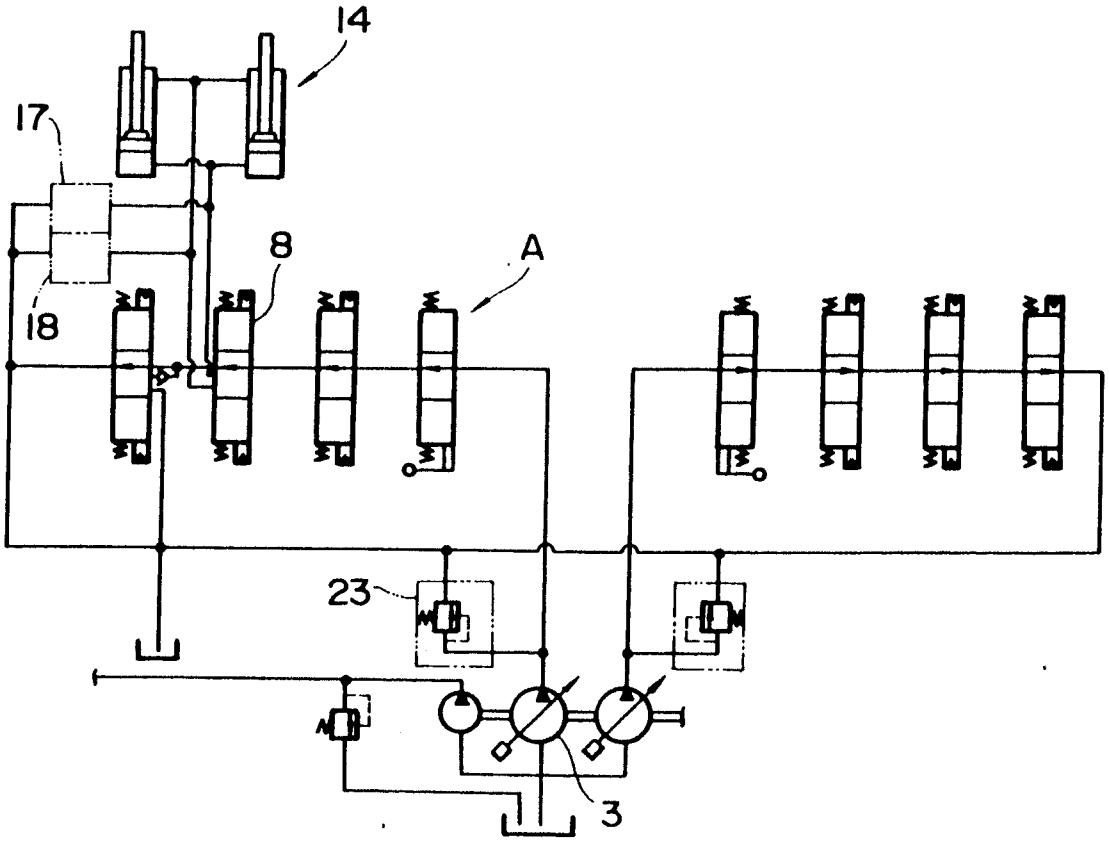
FIG. 3 PRIOR ART
FIG. 3 is a diagram of a hydraulic system in a prior art general-purpose hydraulic shovel.
Figure 4:
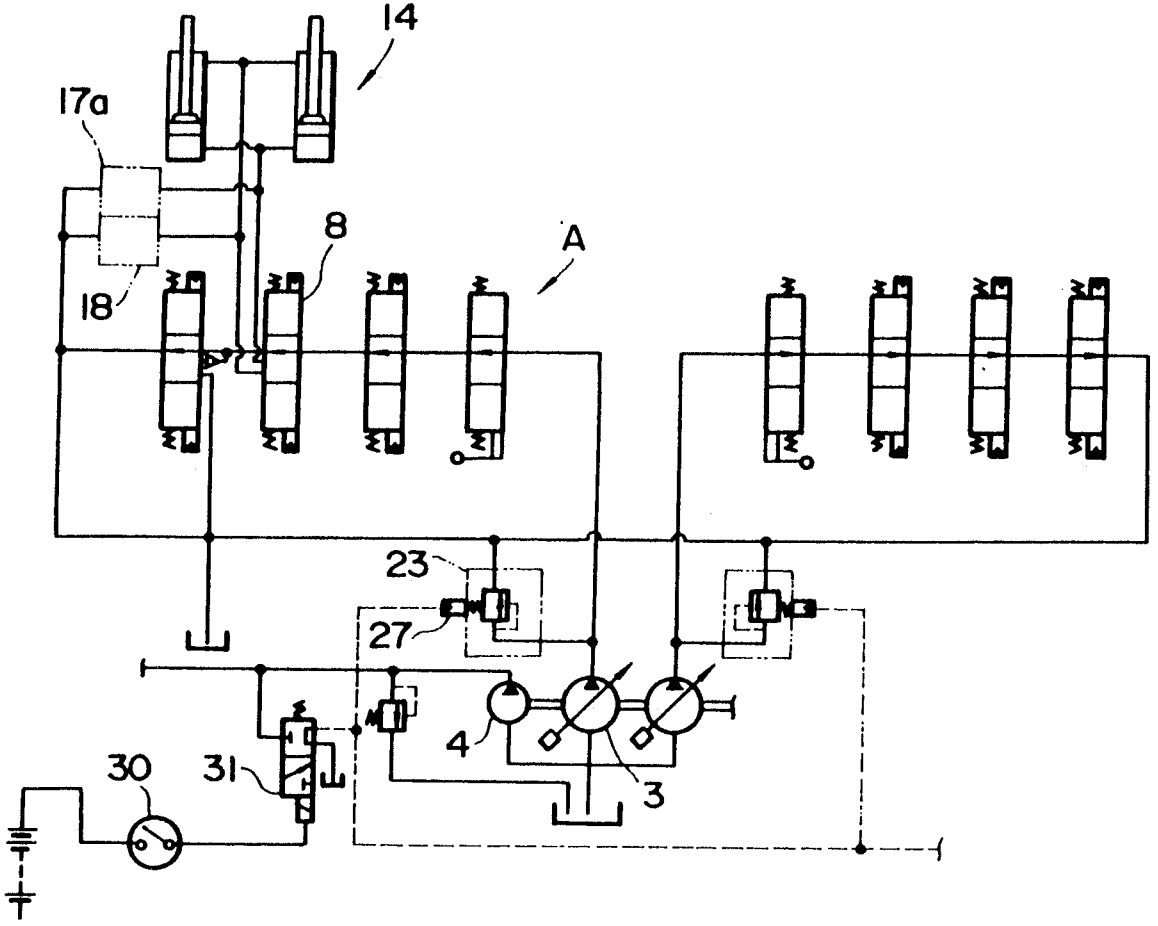
FIG. 4 PRIOR ART
FIG. 4 is a diagram of a hydraulic system in a hydraulic shovel having a boosting device in the prior art.
Figure 5:
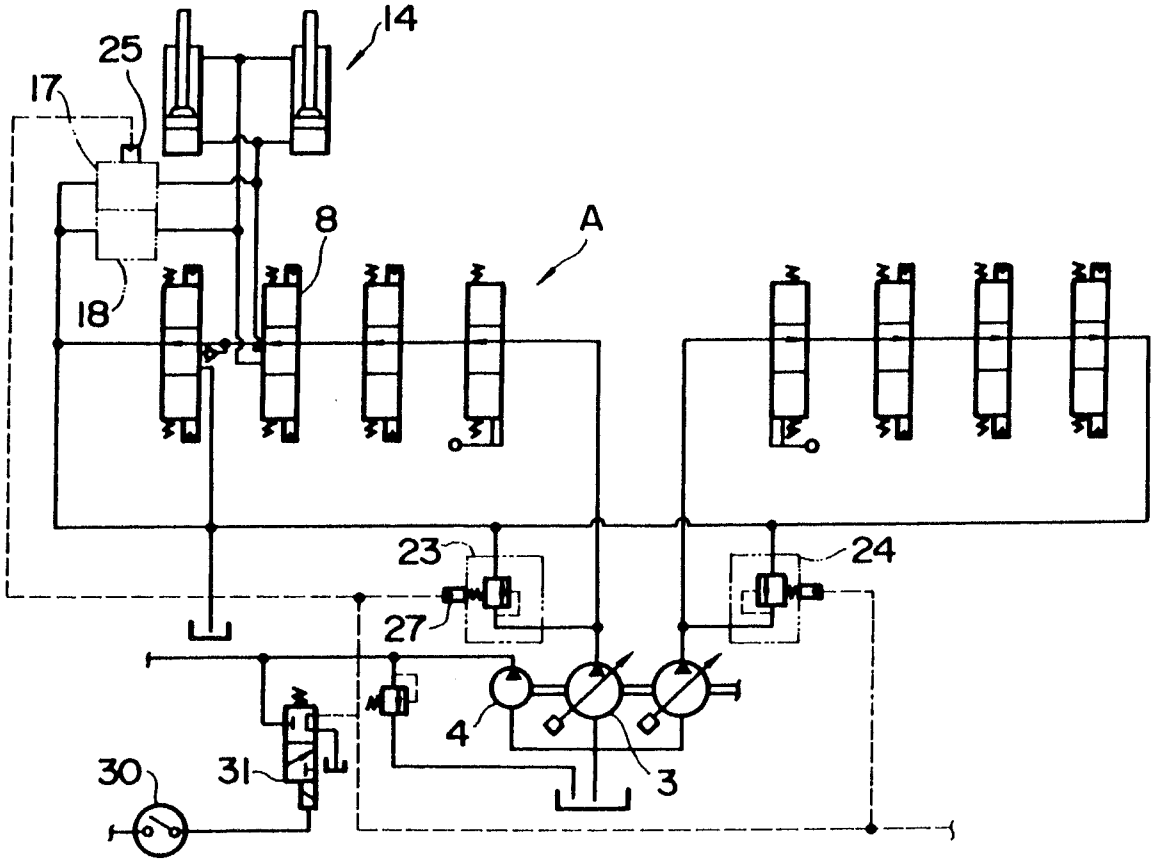
FIG. 5 PRIOR ART
FIG. 5 is a diagram of a hydraulic system which is a prior art improvement of FIG. 4.

FIG. 2 shows an electric and hydraulic system according to a second preferred embodiment of the present invention, wherein the same parts as those in FIG. 1 are designated by the same reference numerals. The second preferred embodiment is different from the first preferred embodiment in the following respects. Firstly, while the discharge pressure oil from the pilot pump 4 is employed for the hydraulic source for the hydraulic signal generating means 31 in the first preferred embodiment, the pressure oil from the branch line 14*c* extending from the head-side oil chamber 14*a* of the hydraulic cylinder 14 where a load pressure due to a dead weight of the working device, a weight of an object to be lifted, etc. is employed for the hydraulic source for hydraulic signal generating means 35 consisting of a pressure reducing valve 36 and a selector valve 37 in the second preferred embodiment. Secondly, a relay circuit 32 is provided between each receiving section of the selector valve 29 and the hydraulic signal generating means 35 and the switch 30. In other words, the signal from the switch 30 is connected and cut through the relay circuit 32. The relay circuit 32 includes a pressure switch 33 adapted to close an internal electric circuit when the pressure in the branch line 14*c* is increased near a normal relief set pressure of the port relief valve 17 and a make contact 34 adapted to be closed when a signal is supplied from the switch 30. Once the make contact 34 is closed, it continues to be closed and output a signal irrespective of an open or closed state of the switch 30 as long as the pressure switch 33 is closed, thus forming a retaining circuit.

Accordingly, during a hoisting work with the hydraulic shovel having the electric and hydraulic system as shown in FIG. 2, in the event that the engine 1 is stopped by any causes to stop the supply of the discharge oil pressure from the pilot pump 4, or that the operator erroneously opens the switch 30 or unintentionally releases a push-button switch when employed in substitution for the switch 30, there is no possibility that the boosted condition of the relief valves will be eliminated or that an object being hoisted will fall.

Although the above-mentioned preferred embodiments employ the electric and hydraulic signals as a signal medium in connection with an equipment to be used, a pneumatic signal and/or a mechanical link-cable may be employed solely or in combination. Further, although the description in the above preferred embodiments concerning an actuator is directed to the boom, arm and bucket cylinders of the hydraulic shovel, the present invention may be applied to any other hydraulic construction and working machine such as a tractor shovel similar to the hydraulic shovel, wherein a working device is replaced for plural purposes, and each working device is required to exhibit different outputs for different works.

As described above, the hydraulic circuit according to the present invention is advantageously applied to a construction and working machine such as a hydraulic shovel to be subjected to various kinds of works differing in load conditions according to working contents. That is, the set pressures of the main relief valve and the port relief valve suitably set for a normal construction operation where an impact load is applied can be boosted when the machine is subjected to other operations where no impact load is applied. Therefore, a variety of operations can be efficiently effected by the same machine. Moreover, when the relief set pressure is boosted, the execution of operations generating an impact load are automatically suppressed to thereby prevent damage of the machine.

According to another aspect of the present invention, a simple circuit is additionally provided to ensure the safety in a hoisting work, for example. That is, during hoisting a heavy load under a boosted relief set pressure, even when the engine is stopped or the switch for boosting the relief set pressure is erroneously opened, the relief set pressure can be boosted by a load pressure during hoisting the heavy load. Furthermore, once a signal is supplied from the switch, it continues to be output irrespective of the subsequent operation of the switch as far as the load pressure is not reduced. Therefore, it is possible to prevent that the heavy load being hoisted will fall, thus ensuring the safety hoisting operation.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. In a hydraulic construction and working machine having an engine, a main pump adapted to be driven by said engine, a plurality of hydraulic selector valves adapted to be supplied with a discharge pressure oil from said main pump, and a plurality of actuators for operating a plurality of working devices, said actuators being supplied with the pressure oil from said hydraulic selector valves to effect various kinds of work, a hydraulic circuit comprising:

a main relief valve for relieving the discharge pressure from said main pump when the discharge pressure exceeds a predetermined pressure;

a plurality of port relief valves for preventing pressures in lines connected to said actuators from becoming higher than a predetermined pressure;

boost receiving means associated with said main relief valve and with at least one of said port relief valves for boosting set pressures of said main relief valve and said at least one of said port relief valves in response to receipt of an external hydraulic signal;

a hydraulic signal generating means for generating a hydraulic signal for operating said boost receiving means in response to receipt of a command signal at a receiving section thereof, said hydraulic signal being supplied by a pressure oil in a line leading to said at least one of said port relief valves;

a switch adapted to be arbitrarily opened and closed by an operator to generate said command signal; and a relay circuit for outputting said command signal through said switch to said receiving section of said hydraulic signal generating means, said relay circuit maintaining outputting of said command signal as long as a pressure of said pressure oil in said line leading to said at least one of said port relief valves is higher than a predetermined pressure, irrespective of an open or closed state of said switch after start of outputting of said signal.

2. A hydraulic circuit comprising:

a main pump;

a plurality of hydraulic selector valves adapted to be supplied with a discharge pressure oil from said main pump;

a plurality of actuators for operating a plurality of working devices;

a main relief valve for relieving the discharge pressure from said main pump when the discharge pressure exceeds a predetermined pressure;

a plurality of port relief valves for preventing pressures in lines connected to said actuators from becoming higher than a predetermined pressure;

boost receiving means associated with said main relief valve and with at least one of said port relief valves;

a hydraulic signal generating means for supplying a hydraulic signal to said boost receiving means for boosting set pressures of said main relief valve and said at least one of said port relief valves;

an operation suppressing means for maintaining a specific one of said plurality of hydraulic selector valves in a neutral position when said set pressures are boosted;

an electrical control switch arbitrarily controllable by an operator for simultaneously sending an electrical control signal to said hydraulic signal generating means and to said operation suppressing means to simultaneously boost said set pressures and maintain said specific one of said hydraulic selector valves in a neutral position; and a retaining circuit containing a pressure switch, said pressure switch closing in response to a predetermined pressure in a hydraulic line of said hydraulic circuit to prevent elimination of a boosted condition of said set pressures if said engine stops or if said electrical control switch is opened before the pressure in said hydraulic line drops below said predetermined pressure.

3. The hydraulic construction and working machine of claim 2, wherein said specific one of said plurality of hydraulic selector valves responds to operating signals from a remote control valve when said electrical control switch is in an open position, and wherein said specific one of said plurality of hydraulic selector valves does not respond to operating signals from said remote control valve when said switch is in a closed position.

* * * * *